US012208433B2

(12) United States Patent
Fairbarn et al.

(10) Patent No.: US 12,208,433 B2
(45) Date of Patent: Jan. 28, 2025

(54) DIE SURFACES WITH COATINGS

(71) Applicant: MAGNA INTERNATIONAL INC., Aurora (CA)

(72) Inventors: Kyle Daniel Fairbarn, Lefroy (CA); Leslie George Shuman, Smithville (CA); David Camil Polsoni, Woodbridge (CA); Hongping Gu, Newmarket (CA); Aldo Van Gelder, Aurora (CA)

(73) Assignee: MAGNA INTERNATIONAL INC., Aurora (CA)

( * ) Notice: Subject to any disclaimer, the term of this patent is extended or adjusted under 35 U.S.C. 154(b) by 219 days.

(21) Appl. No.: 17/785,745

(22) PCT Filed: Oct. 12, 2020

(86) PCT No.: PCT/IB2020/059563
§ 371 (c)(1),
(2) Date: Jun. 15, 2022

(87) PCT Pub. No.: WO2021/123939
PCT Pub. Date: Jun. 24, 2021

(65) Prior Publication Data

US 2023/0047227 A1 Feb. 16, 2023

Related U.S. Application Data

(60) Provisional application No. 62/951,450, filed on Dec. 20, 2019.

(51) Int. Cl.

| | |
|---|---|
| ***B21D 22/02*** | (2006.01) |
| ***B21D 37/01*** | (2006.01) |
| ***C23C 24/10*** | (2006.01) |

(52) U.S. Cl.
CPC ..... *B21D 22/022* (2013.01); *B21D 37/01* (2013.01); *C23C 24/106* (2013.01)

(58) Field of Classification Search
CPC ..... B21D 22/02; B21D 22/022; B21D 37/01
See application file for complete search history.

(56) References Cited

U.S. PATENT DOCUMENTS

2014/0140836 A1 5/2014 Embrey et al.
2015/0321288 A1 11/2015 Borek

FOREIGN PATENT DOCUMENTS

CN 1932082 A 3/2007

OTHER PUBLICATIONS

Muller, S. et al., "Applying Functionally Graded Materials by Laser Cladding: a cost effective way to Improve the Lifetime of Die-Casting Dies", Glocalized Solutions for Sustainability in Manufacturing: Proceeding of the 18th CIRP International Conference on Life Cycle Engineering, p. 235-239 (Year: 2011).*

(Continued)

*Primary Examiner* — Debra M Sullivan
(74) *Attorney, Agent, or Firm* — Pillsbury Winthrop Shaw Pittman, LLP

(57) ABSTRACT

A forming system that includes a first die having a first die surface and a second die having a second die surface is provided. The first and the second die surfaces are configured to cooperate to form a die cavity therebetween so as to receive a workpiece therein. Coatings are formed on opposing portions of the first and second die surfaces. The coatings on the opposing portions of the first and the second die surfaces cooperate to be on opposite sides of the workpiece received in the die cavity. A ratio of Vanadium to Tungsten in the coatings is in the range between 0.31 and 0.45. In one embodiment, each of the coatings includes at least two layer (Continued)

configuration. In another embodiment, each of the coatings includes a predetermined thickness.

12 Claims, 14 Drawing Sheets

(56) References Cited

OTHER PUBLICATIONS

Ocylock, S. et al., "Functionally graded multi-layers by laser cladding for increased wear and corrosion protection", Physics Procedia, Jan. 1, 2010, vol. 5 p. 359-367 (Year: 2010).*
Rahman, N. et al, "Development and characterization of multilayer laser cladded high speed steels", Additive Manufacturing, Dec. 1, 2019, vol. 30, 11 pgs. total (Year: 2019).*
International Preliminary Report on Patentability dated Jun. 30, 2022, issued in the corresponding International Application No. PCT/IB2020/059563, filed Oct. 12, 2020, pp. 1-9.
International Search Report and Written Opinion dated Jan. 15, 2021, issued in the corresponding International Patent Application No. PCT/IB2020/059563, pp. 1-14.
Muller, S., et al., "Applying Functionally Graded Materials by Laser Cladding: a cost-effective way to improve the Lifetime of Die-Casting Dies", Glocalized Solutions for Sustainability in Manufacturing: Proceedings of the 18th CIRP International Conference on Life Cycle Engineering, May 2-4, 2011, Braunschweig, Germany, pp. 235-239 (7 pages).
Ocylok, S., et al., "Functionally graded multi-layers by laser cladding for increased wear and corrosion protection", Physics Procedia, Jan. 1, 2010, vol. 5, pp. 359-367.
Rahman, N., et al., "Development and characterization of multilayer laser clodded high speed steels", Additive Manufacturing, Dec. 1, 2018, vol. 24 (23 pages).
Rahman, N., et al., "Directed energy deposition and characterization of high-carbon high speed steels", Additive Manufacturing, Dec. 1, 2019, vol. 30 (100838) (11 pages).
Tuominen, J., et al., "Microstructural and abrasion wear characteristics of laser-clad tool steel coatings", Surface Engineering, Dec. 1, 2016, vol. 32, No. 12, pp. 923-933.
Rahman, N., et al., "Laser metal deposition of vanadium-rich high speed steel: Microstructural and high temperature wear characterization", Surface & Coatings Technology, Apr. 25, 2019, vol. 364, pp. 115-126.
El-Labban, H.F., et al., "Laser cladding of Ti—6Al—4V alloy with vanadium carbide particles", Advances in Production Engineering & Management, Dec. 1, 2014, vol. 9, No. 4, pp. 159-167.
Farhani, M., et al., "The Study of Wear Resistance of a Hot Forging Die, Hardfaced by a Cobalt-Base Superalloy", Materials Forum, 2006, vol. 30, pp. 212-218.

* cited by examiner

| Location | Distance (mm) | Hardness (HRC) |
|---|---|---|
| Clad | 0.75 | 63 |
| | 0.50 | 65 |
| | 0.25 | 66 |
| Fusion line | 0.00 | 63 |
| HAZ/Base (4140) | 0.25 | 47 |
| | 0.50 | 33 |

FIG. 2
(Prior Art)

| Location | Distance (mm) | Hardness Measurement (HRC) | |
|---|---|---|---|
| | | S390 | S390+V |
| Clad | 2.25 | 64 | 64 |
| | 2.00 | 62 | 65 |
| | 1.75 | 62 | 64 |
| | 1.50 | 63 | 65 |
| | 1.25 | 66 | 65 |
| | 1.00 | 66 | 66 |
| | 0.75 | 65 | 65 |
| | 0.50 | 66 | 66 |
| | 0.25 | 64 | 64 |
| Fusion line | 0.00 | 60 | 59 |

FIG. 6

| Powder mix | C | Si | Fe | Cr | Ni | Co | Mo | Mn | W | V |
|---|---|---|---|---|---|---|---|---|---|---|
| Mix_E | 1.15 | 0.38 | 66.79 | 7.10 | 0.20 | 8.31 | 4.10 | 0.25 | 8.49 | 3.24 |
| Mix_H | 1.19 | 0.37 | 65.16 | 7.02 | 0.20 | 8.31 | 4.00 | 0.24 | 9.31 | 4.20 |
| Mix_K | 1.34 | 0.36 | 65.55 | 6.64 | 0.18 | 7.44 | 4.03 | 0.24 | 10.22 | 4.01 |

FIG. 7

| Location | Distance (mm) | Hardness Measurement (HRC) | | |
|---|---|---|---|---|
| | | Powder mix "E" | Powder mix "H" | Powder mix "K" |
| Clad | 0.75 | 62 | 65 | 64 |
| | 0.50 | 64 | 64 | 64 |
| | 0.25 | 63 | 63 | 64 |
| Fusion line | 0.00 | 57 | 57 | 59 |
| HAZ/Base | 0.25 | 46 | 46 | 48 |
| | 0.50 | 32 | 43 | 34 |

FIG. 8

DIE SURFACES WITH COATINGS

CROSS-REFERENCE TO RELATED APPLICATION

This application is the U.S. national phase entry of PCT Patent Application No. PCT/IB2020/059563, filed Oct. 12, 2020, which is based upon and claims the benefit of priority of U.S. Provisional Patent Application No. 62/951,450, filed Dec. 20, 2019, each of which is incorporated herein in its entirety by reference.

FIELD

The present patent application relates to a system and a method for producing a vehicle body assembly.

BACKGROUND

Vehicle manufacturers strive to provide vehicles that are increasingly stronger, lighter and less expensive. For example, vehicle manufacturers have expended significant efforts to utilize non-traditional materials, such as sheet aluminum, advanced high strength steels, and ultra-high strength steels, for portions of the vehicle body. While such materials may be both relatively strong and light, they are typically costly to purchase, form and/or assemble.

Hot forming generally comprises heating a blank in a furnace, followed by stamping the heated blank between a pair of dies to form a shaped part, and quenching the shaped part between the dies. The blank is generally heated in the furnace to achieve an austenitic microstructure, and then quenched in the dies to transform the austenitic microstructure to a martensitic microstructure. The known hot forming dies for performing the simultaneous hot forming and quenching procedures typically employ cooling passages (for circulating coolant through the hot forming die) that are formed in a conventional manner.

The present patent application provides improvements to hot forming/stamping systems and/or methods.

SUMMARY

One aspect of the present patent application provides a forming system. The forming system includes a first die having a first die surface and a second die having a second die surface. The first and the second die surfaces are configured to cooperate to form a die cavity therebetween so as to receive a workpiece therein. Coatings are formed on opposing portions of the first and second die surfaces. The coatings on the opposing portions of the first and the second die surfaces cooperate to be on opposite sides of the workpiece received in the die cavity. A ratio of Vanadium to Tungsten in the coatings is in the range between 0.31 and 0.45. Each of the coatings includes a predetermined thickness.

Another aspect of the present patent application provides a method for forming a die. The method comprises forming a die having a die surface; and applying coatings on the die surface of the die using a laser cladding procedure. The coatings includes a predetermined thickness, and a ratio of Vanadium to Tungsten in the coatings is in the range between 0.31 and 0.45.

These and other aspects of the present patent application, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the present patent application, the structural components illustrated herein are drawn to scale. It is to be expressly understood, however, that the drawings are for the purpose of illustration and description only and are not intended as a definition of the limits of the present patent application. It shall also be appreciated that the features of one embodiment disclosed herein can be used in other embodiments disclosed herein. As used in the specification and in the claims, the singular form of "a", "an", and "the" include plural referents unless the context clearly dictates otherwise.

BRIEF DESCRIPTION OF THE DRAWINGS

FIG. 2 shows a table with hardness measurement values of the prior art/unmodified/existing S390 material layer, hardness measurement values at the fusion line and hardness measurement values at the heat-affected zone;

FIG. 4A shows a two layer structure of the existing/unmodified/prior art S390 powder/material, while

FIG. 6 shows a table with hardness measurement values of the modified/improved S390 material coating layer in accordance with an embodiment of the present patent application, and hardness measurement values at the fusion line;

FIG. 7 shows a table with three different compositions of the modified/improved S390 material in accordance with one embodiment of the present patent application;

FIG. 8 shows a table with hardness measurement values of the three different compositions of the modified/improved S390 material coating layer in accordance with an embodiment of the present patent application, hardness measurement values at the fusion line, and hardness measurement values at the heat-affected zone;

DETAILED DESCRIPTION OF THE DRAWINGS

Figure 1:
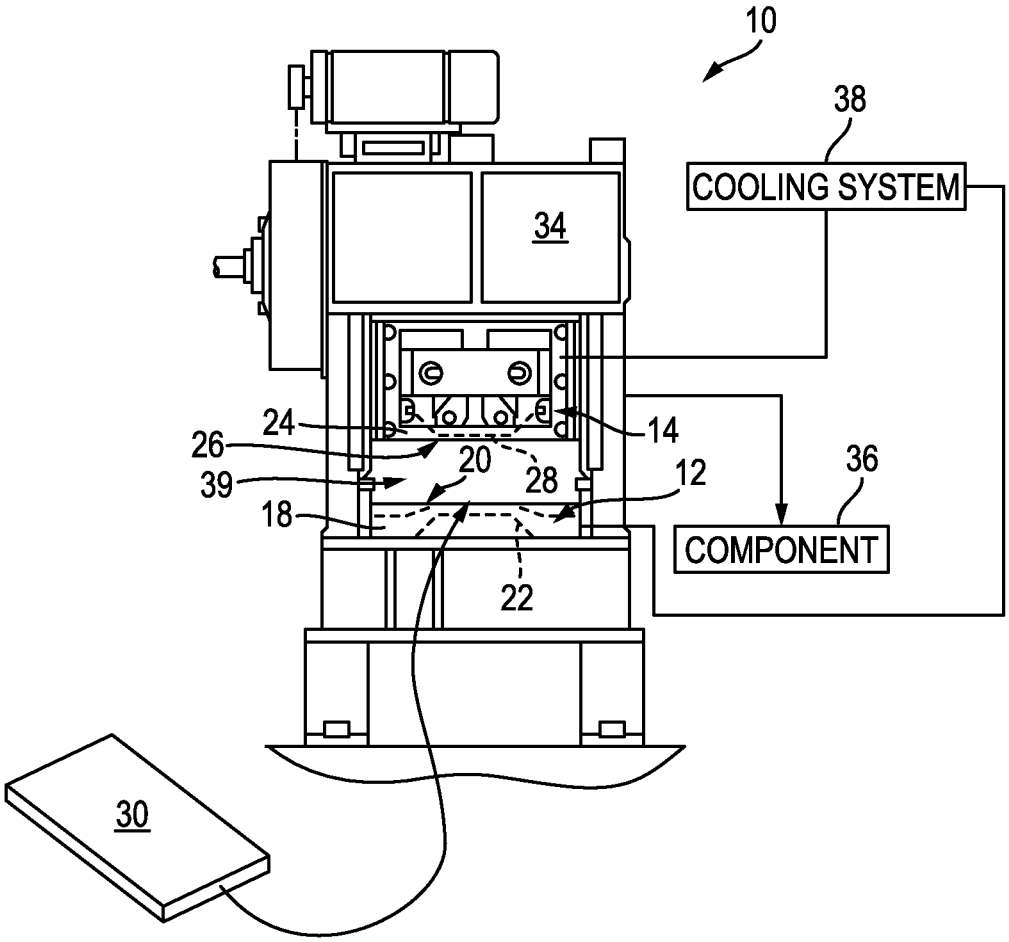
FIG. 1 is a schematic diagram of a forming system in accordance with an embodiment of the present patent application.

FIG. 1 shows a hot forming system 10 for producing a vehicle body assembly or a vehicle body member. Referring to FIG. 1, the hot forming system 10 includes a first die 12, a second die 14, and a cooling system 38 operatively associated with the first die 12 and the second die 14.

In illustrative embodiment, the first die 12 is shown as a lower die. In another embodiment, the first die 12 may be an upper die. The first die 12 has a first die body 18 and a first die surface 20. In one embodiment, the first die body 18 may be formed of a heat conducting material such as tool steel, in particular DIEVAR®, which is marketed by Bohler-Uddeholm Corporation of Rolling Meadows, Ill., or commercially available H-11 or H-13. In one embodiment, the first die surface 20 may include a complex forming die surface. The first die body 18 may also include a plurality of cooling channels 22 in at least a portion thereof.

In illustrative embodiment, the second die 14 is shown as an upper die. In another embodiment, the second die 14 may be a lower die. In one embodiment, the second die 14 may include a second die body 24 that may be formed of a tool steel, such as DIEVAR® or commercially available H-11 or H-13, a second die surface 26 and a plurality of cooling channels 28 in at least a portion thereof. In one embodiment, the second die surface 26 may include a complex forming die surface.

As used herein, the term "die surface" refers to the portion of the exterior surface of a die that forms a hot formed component. Moreover, the term "complex die surface" as used in this description means that the die surface has a three-dimensionally contoured shape.

The hot forming die set 12 and 14 may be mounted in a stamping press 34 and may be coupled to the cooling system 38. In one embodiment, the stamping press 34 may be configured to close the first and second dies 12 and 14 in a die action direction to deform a workpiece 30 received between the first and second dies 12 and 14 so as to form and optionally trim a hot formed member 36. In one embodiment, the stamping press 34 may be configured to maintain the dies 12 and 14 in a closed relationship for a predetermined amount of time to permit the hot formed member 36 to be cooled to a desired temperature.

The cooling system 38 may include a source of cooling fluid. In one embodiment, cooling fluid may include water, gas or other fluid medium. Cooling fluid, provided by the cooling system 38, may be continuously circulated through the cooling channels 22 and 28 to cool the dies 12 and 14, respectively. In one embodiment, the cooling system 38 may include a reservoir/chiller and a fluid pump. It may be appreciated that circulating cooling fluids cools the dies 12 and 14 and that the dies 12 and 14 quench and cool the hot formed member 36.

In one embodiment, the cooling channels 22, 28 may be formed by techniques such as gun drilling that yield straight channels extending through the respective die bodies. In one embodiment, the cooling channels 22, 28 are formed by gun drilling the cooling channels through one or two sides of the respective die bodies.

In one embodiment, each cooling channel 22 may be offset from the die surface 20 by a first predetermined distance and this distance may be consistent along the length of the cooling channels 22. Similarly, each cooling channel 28 may be offset from the die surface 26 by a second predetermined distance, which may be different from the first predetermined distance, and this distance may be consistent along the length of the cooling channels 28. In another embodiment, the second predetermined distance may be the same as the first predetermined distance.

The first and the second die surfaces 20 and 26 are configured to cooperate to form a die cavity 39 therebetween so as to receive the workpiece 30 therein. In one embodiment, the die cavity 39 is configured to have a shape that corresponds to a final shape of the workpiece after the hot forming operation/procedure.

In one embodiment, the workpiece 30 may be a blank, which may be formed of a heat-treatable steel, such as boron steel. In another embodiment, the workpiece 30 may be stamped from a sheet of hardenable steel, such as Usibor®1500P or Usibor® 1500, boron steel or any suitable hot stamp press hardened material. In one embodiment, the workpiece 30 may be pre-shaped specifically for producing a desired shaped hot formed product, such as, for example, by an additional cutting procedure or an additional cold forming procedure. In one embodiment, the additional cutting procedure or additional cold forming procedure may be optional.

In one embodiment, the hot formed member 36 is a vehicle body member or vehicle body assembly. In one embodiment, the vehicle body component that is formed or produced by the system of FIG. 1 may include a B column or B pillar for a vehicle. Of course, other types of members may be produced in a similar fashion, and the example of the B pillar is provided merely for illustrative purposes and in order to facilitate a better understanding of the embodiments of the present patent application.

Figure 3:
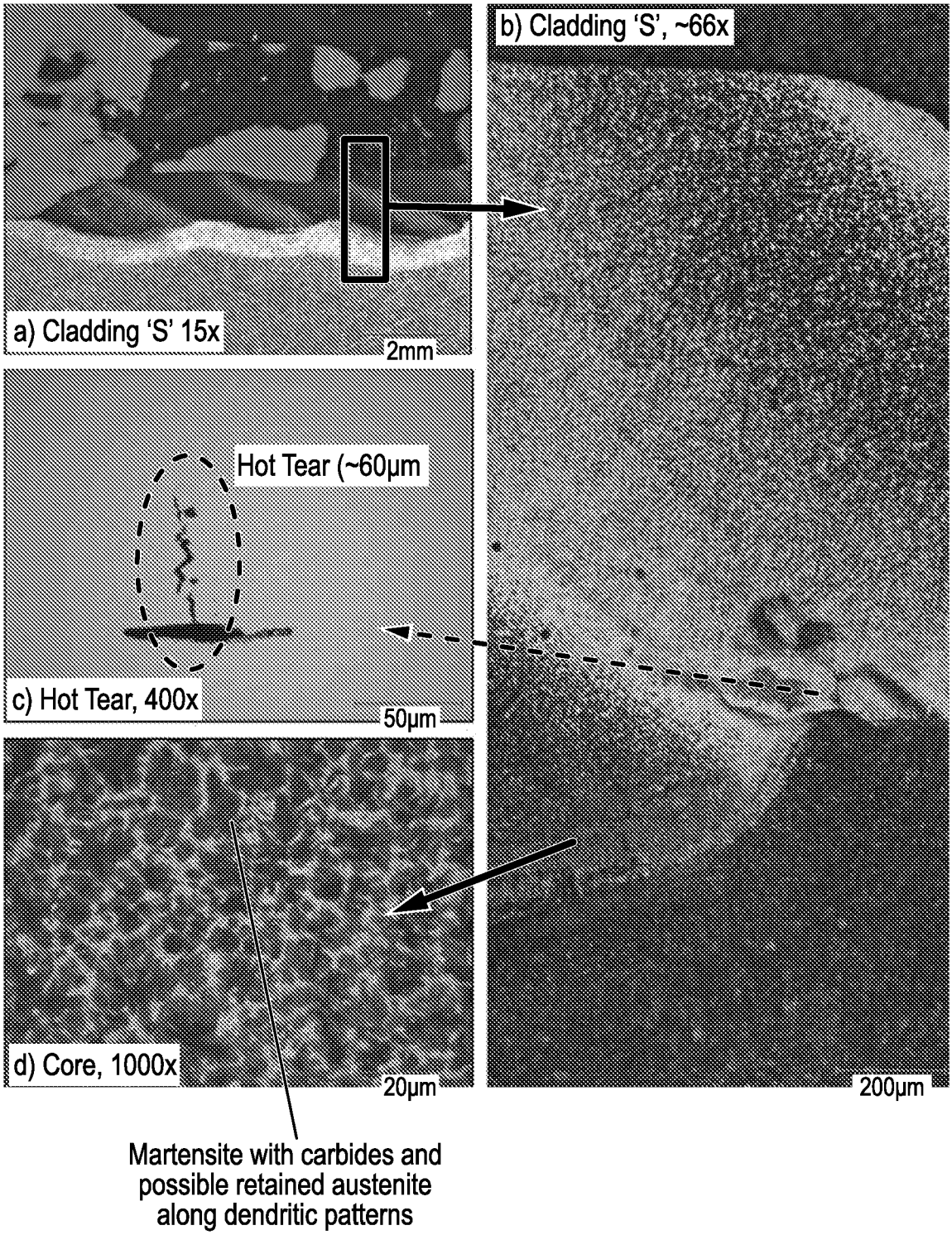
FIG. 3 (Prior Art)
FIG. 3 shows different views of a single pass thin layer structure of the coating including the prior art/unmodified/existing S390 material.

Referring to FIG. 3, a laser cladding process is generally used to form a single pass thin coating layer on each of the first and the second die surfaces 20 and 26. The coating includes the prior art/unmodified/existing S390 powder. The prior art/unmodified/existing S390 powder is a high speed steel. This is manufactured by Bohler and marketed under the name Bohler S390. The details about the prior art/unmodified/existing S390 powder can be found in http://www.bohler.ca/media/productdb/downloads/S390DE.pdf. The coating layer thickness is approximately 1 millimeter at the valley bottom of the cladding lines. No obvious crack can be seen on top surface. One hot tear was found at the root of one cladding track (pass). The core microstructure was found to comprise of martensite with small carbides and presumed retained austenite arranged in a columnar and dendritic pattern. It was found that this single layer coating of the S390 material can be produced without obvious cracks. It was also found that a defect-free S390 material coating layer can be achieved more readily for thinner coating layers having thickness less than 1 millimeter. FIG. 2 shows a table with hardness measurement values of the coating layer with the prior art/unmodified/existing S390 material, hardness measurement values at the fusion line and hardness measurement values at the heat-affected zone. The average hardness in the coating layer is about 64 HRC.

Applicant of the present patent application has found that the unmodified/existing S390 powder/material does not allow for more than one coating layer (e.g., multiple layer coating configuration) deposited via the laser cladding procedure. That is, if a single layer coating/deposit is formed using the unmodified/existing S390 powder/material, the structure of the coating/deposit has no issues. Multiple layer cladding of the unmodified/existing S390 powder/material includes dual layer cladding to approximately a thickness of 2 millimeters. Multiple cracks & porosity are visible in the second layer of the coating with the unmodified/existing S390 powder after the top surface of the coating layer is ground. That is, once a second coating layer and/or a thicker (i.e., more than 1 millimeter thickness) coating layer is applied using the unmodified/existing S390 powder, the resultant structure provides cracking and/or porosity. This ultimately results in de-layering or flaking of the deposit/coating.

The present patent application provides an improved/modified S390 powder/material that includes mechanical properties similar to that of the S390 powder while minimizing cracking and porosity. That is, the improved/modified S390 powder of the present patent application is configured to reduce cracking & porosity in a multilayer structure/configuration. The improved/modified S390 powder of the present patent application is also configured to optimize the single pass process by extending the maximum possible cladding thickness. In one embodiment, the clad layer thickness is configured to be controlled by process speed and powder feed rate. The improved/modified S390 powder/material of the present patent application is described in detail below.

Figure 12:
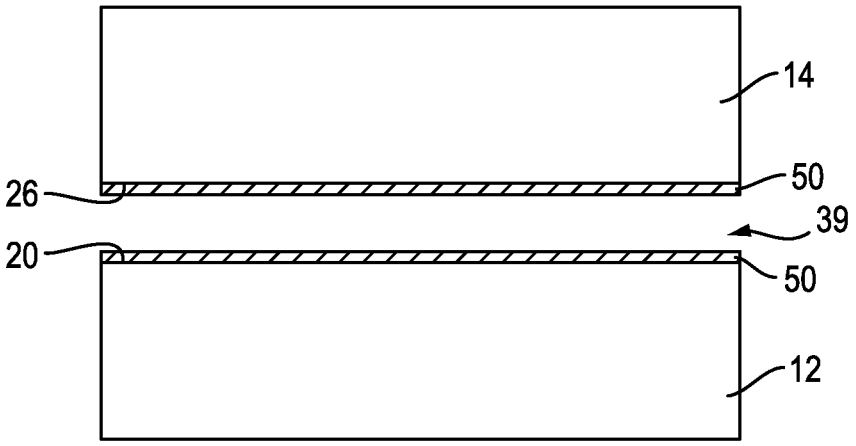
FIG. 12 shows dies of the forming system with modified/improved S390 material coatings thereon in accordance with an embodiment of the present patent application, wherein the coatings have a predetermined thickness.

Referring to FIGS. 1 and 12, in one embodiment, the present patent application provides the forming system 10. The forming system 10 includes the first die 12 having the first die surface 20 and the second die 14 having the second die surface 26. The first and the second die surfaces 20 and 26 are configured to cooperate to form the die cavity 39 therebetween so as to receive the workpiece 30 therein. Coatings 50 are formed on opposing portions of the first and second die surfaces 20 and 26. The coatings 50 on the opposing portions of the first and the second die surfaces 20 and 26 cooperate to be on opposite sides of the workpiece 30 received in the die cavity 39.

In one embodiment, a ratio of Vanadium to Tungsten in the coatings 50 is in the range between 0.31 and 0.45. In one embodiment, each of the coatings 50 includes at least two layer configuration. In another embodiment, each of the coatings 50 includes a predetermined thickness. In one embodiment, the predetermined thickness of each of the coatings 50 is at least 2 millimeters. In one embodiment, the predetermined thickness of each of the coatings 50 is in the range between 0.75 millimeters and 1.25 millimeters thickness. In one embodiment, the coatings 50 includes a predetermined width. In one embodiment, the predetermined width of each of the coatings 50 is in the range between 3 millimeters and 5 millimeters.

Figure 13:
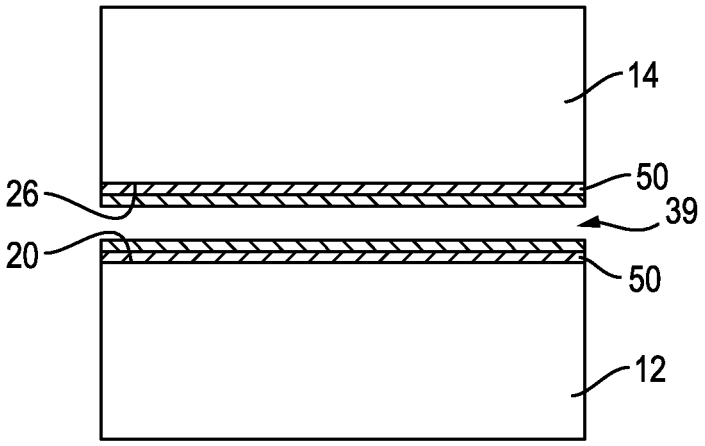
FIG. 13 shows dies of the forming system with modified/improved S390 material coatings thereon in accordance with an embodiment of the present patent application, wherein the coatings have at least two layer configuration.

For example, FIG. 12 shows dies 12, 14 of the forming system 10 with modified/improved S390 material coatings 50 thereon, wherein the coatings 50 have a predetermined thickness. FIG. 13 shows dies 12, 14 of the forming system 10 with modified/improved S390 material coatings 50 thereon, wherein the coatings 50 have at least two layer configuration.

In one embodiment, in the two layer coating configuration, each layer of the coating includes the same material. In one embodiment, in the two layer coating configuration, each layer of the coating is deposited layer by layer, that is, one layer at a time. In one embodiment, the deposited first layer of the two layer coating configuration is cured, dried or cooled before applying the second layer of the two layer coating configuration. In one embodiment, there is no time lapse between two layers. That is, as soon as one layer is complete, the next layer is applied from the same starting point as the first layer. In one embodiment, there is no cooling of the first layer before applying the second layer of the two layer coating configuration.

In one embodiment, the coatings 50 formed on the opposing portions of the first and second die surfaces 20, 26 form a relatively high wear resistance die region, a relatively high surface hardness die region, a relatively high toughness die region and/or a relatively high compressive strength die region. In one embodiment, the coatings 50 formed on the opposing portions of the first and second die surfaces 20, 26 provide high impact resistance, high strength, high toughness and/or high wear resistance to the respective die. In one embodiment, the coatings 50 formed on the opposing portions of the first and second die surfaces 20, 26 substantially prolong the service life of the die.

In general, mechanical friction between the die surface(s) and the workpiece, during the hot forming procedures, leads to die wear. In one embodiment, some portions of the first and second die surfaces 20, 26 are prone to higher wear than other portions of the first and second die surfaces 20, 26. In one embodiment, the coatings 50 are only formed on those portions of the first and second die surfaces 20, 26 that are subject to high wear during a hot forming procedure. In one embodiment, the coatings 50 are formed on those portions of the first and second die surfaces 20, 26 that are subject to high contact stresses and pressures during a hot forming procedure. In one embodiment, the coatings 50 are formed on the entire first and second die surfaces 20, 26.

In one embodiment, the coatings may be laser clad on opposing portions of the first and second die surfaces 20 and 26. In another embodiment, the coatings may be laser sintered on opposing portions of the first and second die surfaces 20 and 26. In yet another embodiment, the coatings may be formed or deposited, using an additive manufacturing procedure on opposing portions of the first and second die surfaces 20 and 26.

In one embodiment, the coatings may have powdered material configuration. In one embodiment, the coatings may be sprayed on to the die bodies. In one embodiment, the coatings may be in the form of a clad material. In one embodiment, the coatings may include a spray multilayer coating.

Figure 15:
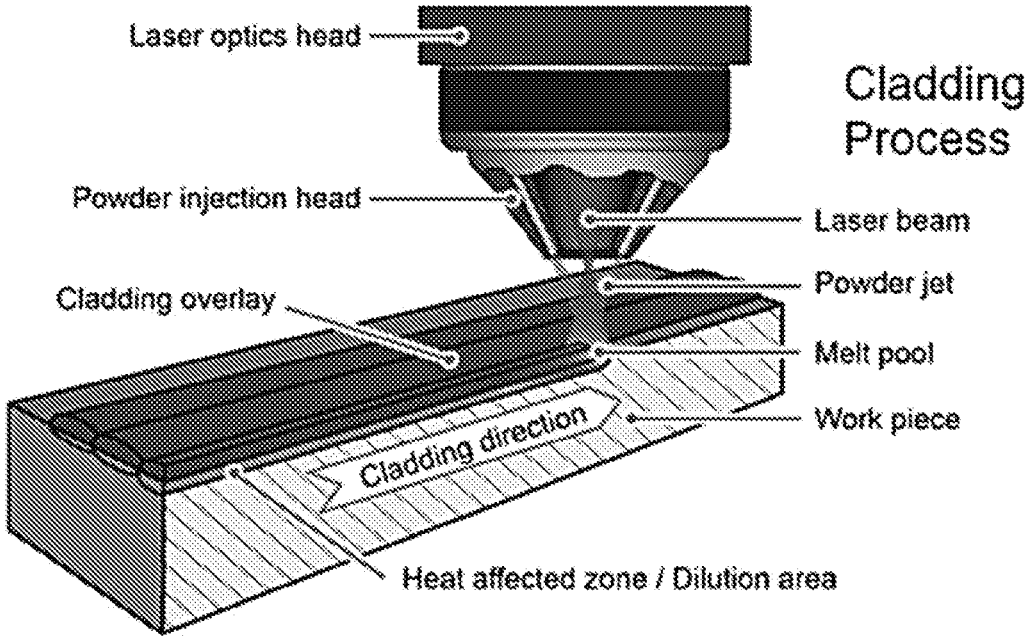
FIG. 15 shows an exemplary laser cladding procedure.

In one embodiment, the coatings may be formed on the die bodies using a laser cladding procedure. In one embodiment, a laser cladding process is generally used to form a single pass thin coating layer on each of the first and the second die surfaces 20 and 26. The procedure also includes binding the material together to form the desired geometry of the coatings. In one embodiment, the desired geometry of the coatings is formed (i.e., built up additively) layer by layer. FIG. 15 shows an exemplary laser cladding procedure/process. FIG. 15 shows a workpiece having a cladding overlay thereon when the workpiece is being moved in a cladding direction under a laser cladding system. The laser cladding system includes a laser optics head, a powder injection head, and a laser beam. FIG. 15 also shows melt pool and powder jet.

In one embodiment, the coatings may be formed on the die bodies using a laser sintering procedure. The laser sintering procedure is an additive manufacturing procedure in which a laser device is used as the power source to sinter powdered coatings. The procedure also includes binding the material together to form the desired geometry of the coatings. In one embodiment, the desired geometry of the coatings is formed (i.e., built up additively) layer by layer.

In one embodiment, the laser sintering procedure may be selective laser sintering or direct metal laser sintering.

In another embodiment, the coatings may be formed on the die bodies using a laser metal deposition procedure. The laser metal deposition procedure generally uses a laser device as the power source to form a melt pool on a substrate material (e.g., metallic substrate). The improved/modified S390 material (e.g., powder) is fed into the melt pool and is absorbed into the melt pool to form a deposit/coating that is fusion bonded to the substrate material. Like the laser sintering procedure, the laser metal deposition procedure is an additive manufacturing procedure in which the desired geometry of the coating is formed (i.e., built up additively) layer by layer.

In other embodiments, other additive manufacturing procedures, which are similar to the laser metal deposition procedure and the laser sintering procedure (described above), may be used in the present patent application. In one embodiment, the additive manufacturing procedure may generally refer to a procedure in which the coatings are formed on the respective die surface(s) by adding layer-upon-layer of the improved/modified S390 material of the present patent application. In one embodiment, the additive manufacturing procedure is configured to provide a uniform molecular thermal bond between the coating and its respective die bodies, for example, without air pockets or weld slag. In one embodiment, laser melting procedure may be used to deposit or form coating layer(s) on the respective die surface(s).

In one embodiment, the improved/modified S390 powder/material of the present patent application is a high speed steel material produced by powder-metallurgy methods. In one embodiment, the improved/modified S390 powder/material of the present patent application is referred to as power-metallurgy material.

In one embodiment, the improved/modified S390 powder of the present patent application, because of its properties, retains its hardness at high temperatures. This property (i.e., retains its hardness at high temperatures) is ideal as a powder/material is used in a laser cladding process to repair badly worn Dievar Form Steels in a Hot Stamp Production Environment.

In another embodiment, the improved/modified S390 powder/material of the present patent application is used as a means to enhance the life cycle of our Hot Stamp Form Steels. This is done by adding the modified/improved S390 powder/material to the high wear areas via the laser cladding, prior to final machining. This procedure is configured to increase resistance to wear during stamping process.

In one embodiment, the improved/modified S390 powder of the present patent application is a derivative alloy of the S390 powder and is configured to enable multi-layer deposition in the laser cladding process. The existing S390 powder is not capable of multi-layer deposition. The improved S390 powder of the present patent application has multi-layer deposition capabilities.

In one embodiment, the improved/modified S390 powder of the present patent application is a derivative alloy of the S390 powder and is configured to enable formation of a coating having a thickness of at least 2 millimeters.

In one embodiment, the formulation of the improved S390 powder of the present patent application has no significant impact on the cost of the improved S390 powder.

Deposition of the S390 powder on the die surfaces is configured to allow for repair of hot stamp form steel. Current wear values require 2 to 3 millimeters of the coating material deposits with minimal cracking and porosity.

In one embodiment, the improved/modified S390 powder of the present patent application includes modified chemical composition of the existing S390 powder so as to enable hot stamp facilities to perform repairs on worn hot stamp form steels without de-layering of the cladding material.

Figure 4A:
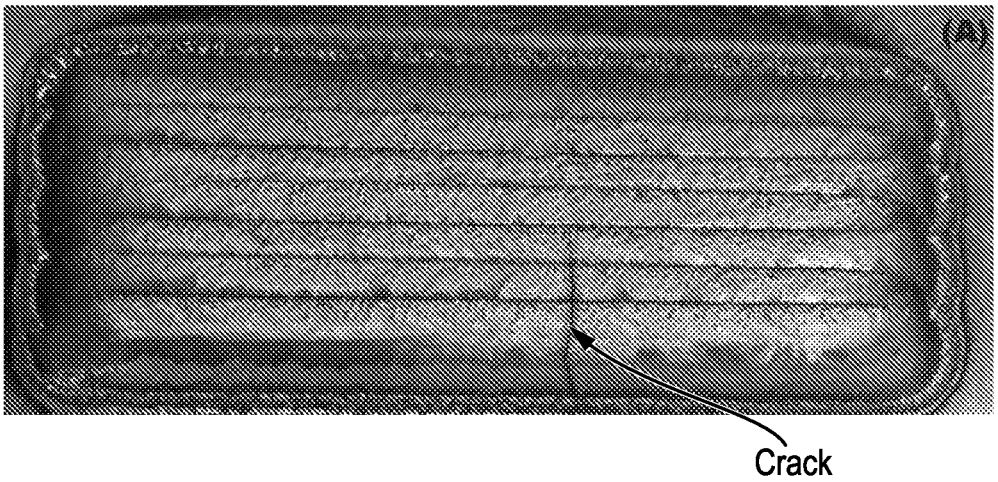
Figure 4B:
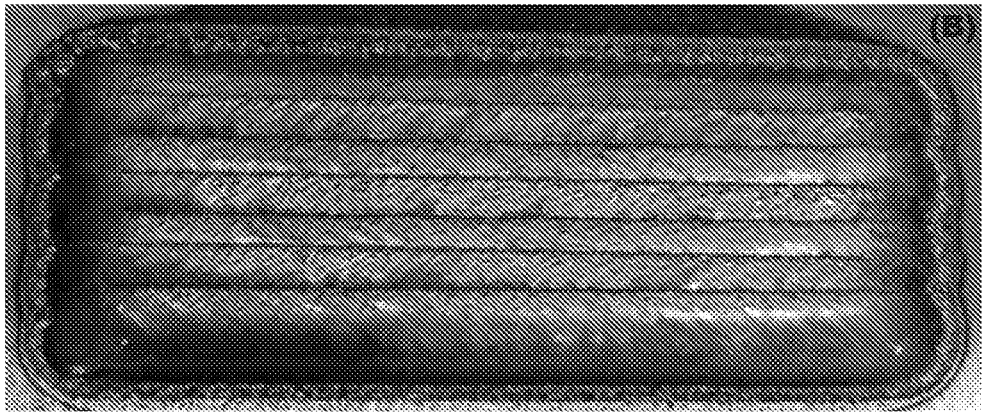
FIG. 4B shows a two layer structure of the improved/modified S390 powder/material in accordance with an embodiment of the present patent application.

In one embodiment, the improved/modified S390 powder of the present patent application is configured to suppress cracks. FIG. 4A shows a two layer structure of the existing/unmodified S390 powder, while FIG. 4B shows a two layer structure of the improved/modified S390 powder of the present patent application. As shown in FIG. 4A, severe crack occurs after application of second layer of cladding using the existing/unmodified S390 powder. Referring to FIG. 4B, no visible cracks are observed in any application layers when the improved S390 powder of the present patent application is used. Thus, the crack suppression for the two layer cladding of S390 powder is achieved by modifying chemistry of the S390 powder.

Figure 5:
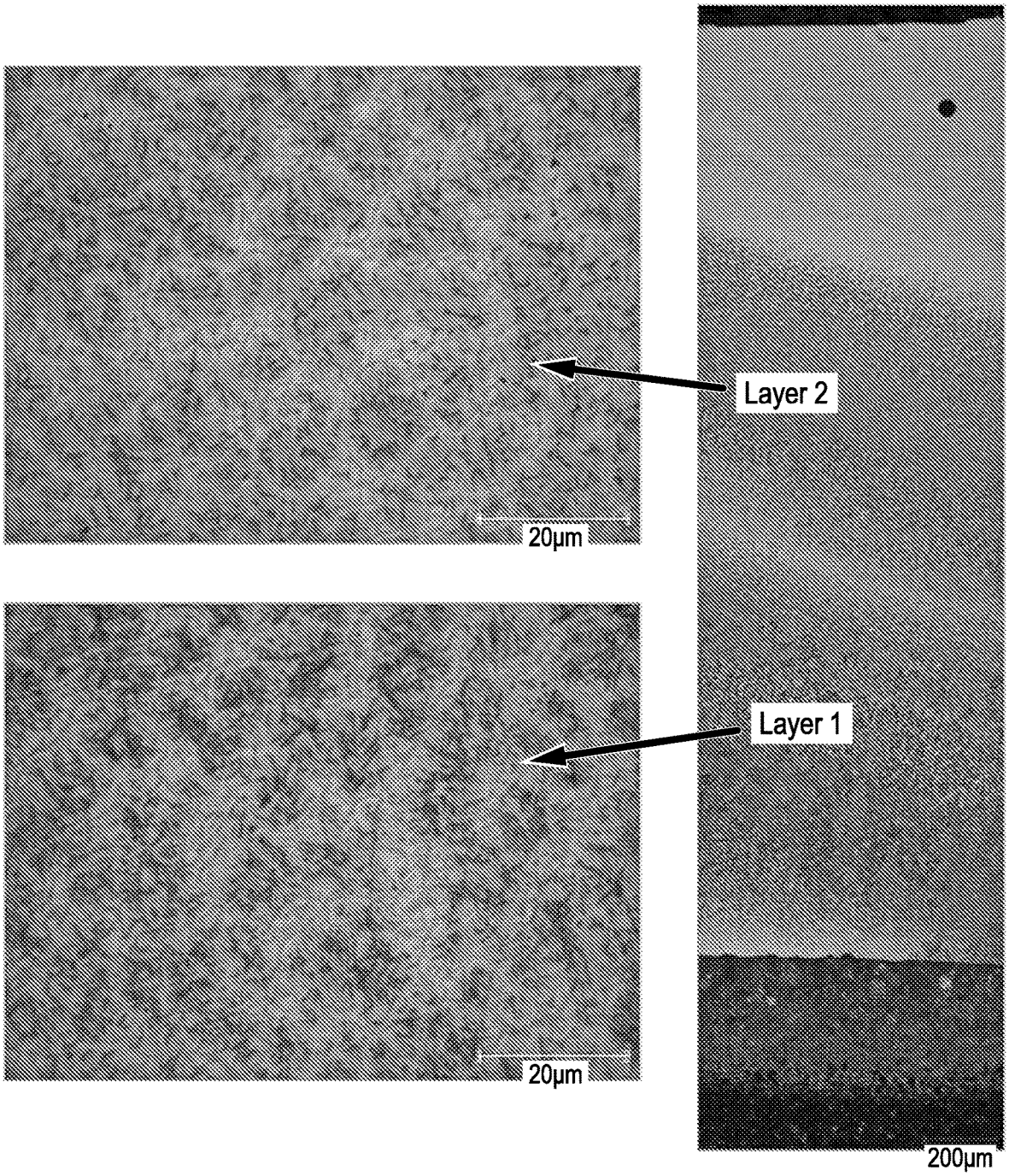
FIG. 5 shows different views of a double layer structure of the coating including the modified/improved S390 material in accordance with an embodiment of the present patent application.

FIG. 5 shows different views of a double layer structure of the coating including the modified/improved S390 material. FIG. 5 shows the cross section of clad double layer using the modified/improved S390 material. There is no obvious change in microstructure in comparison to the cladding with the pure prior art/unmodified S390 powder. For example, the core microstructure was found still to be martensite with fine carbides and possible retained austenite along dendritic patterns.

FIG. 6 shows a table with hardness measurement values of the modified/improved S390 material coating/layer in accordance with an embodiment of the present patent application, and hardness measurement values at the fusion line. As can be seen from FIG. 6, the hardness measurement values of the modified/improved S390 material coating/layer remained high or remained the same (as that for the thicknesses below 1 millimeter) when the thickness of the modified/improved S390 material coating/layer was increased to be more than 1 millimeter (i.e., when the thickness of the modified/improved S390 material coating/layer is between 1 millimeter and 2.5 millimeters).

FIG. 7 shows a table with three different compositions of the modified/improved S390 material in accordance with one embodiment of the present patent application. In one embodiment, successful cladding is achieved by modifying the ratio of Vanadium and Tungsten in the alloy composition. In one embodiment, all the value listed in the table of FIG. 7 are percentages.

In one embodiment, all the three different compositions of the modified/improved S390 material include mechanical properties that are similar to the prior art/unmodified S390 material. In one embodiment, each of the three different compositions of the modified/improved S390 material has the same Red Hardness, the same wear resistance, the same toughness, the same grindability and the same compressive strength for multiple layer deposit configuration as is with a single layer deposit of the unmodified/prior art S390 material.

In one embodiment, each of the three different compositions of the modified/improved S390 material produced/formed a laser clad multi-layer material coating configuration without cracks. In one embodiment, each of the three different compositions of the modified/improved S390 material produced/formed a laser clad coating having a thickness of at least 2 millimeters without cracks. In one embodiment, each of the three different compositions of the modified/improved S390 material has no significant impact on the powder cost.

FIG. 8 shows a table with hardness measurement values of the three different compositions of the modified/improved S390 material coating layer in accordance with an embodiment of the present patent application, hardness measurement values at the fusion line, and hardness measurement values at the heat-affected zone.

Figure 9:
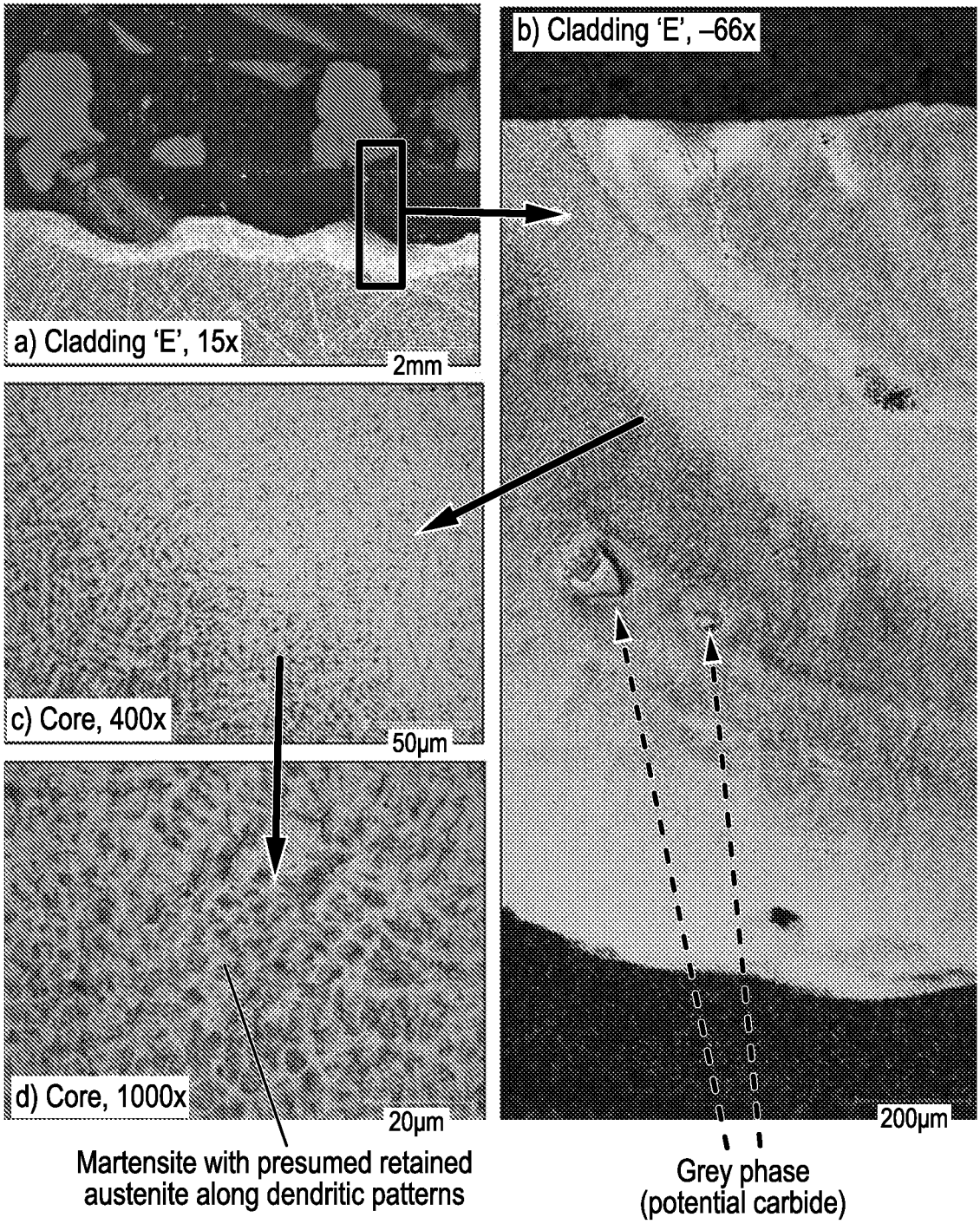
FIG. 9 shows different views of a double layer structure of the coating including the modified/improved S390 material in accordance with one embodiment of the present patent application.
Figure 10:
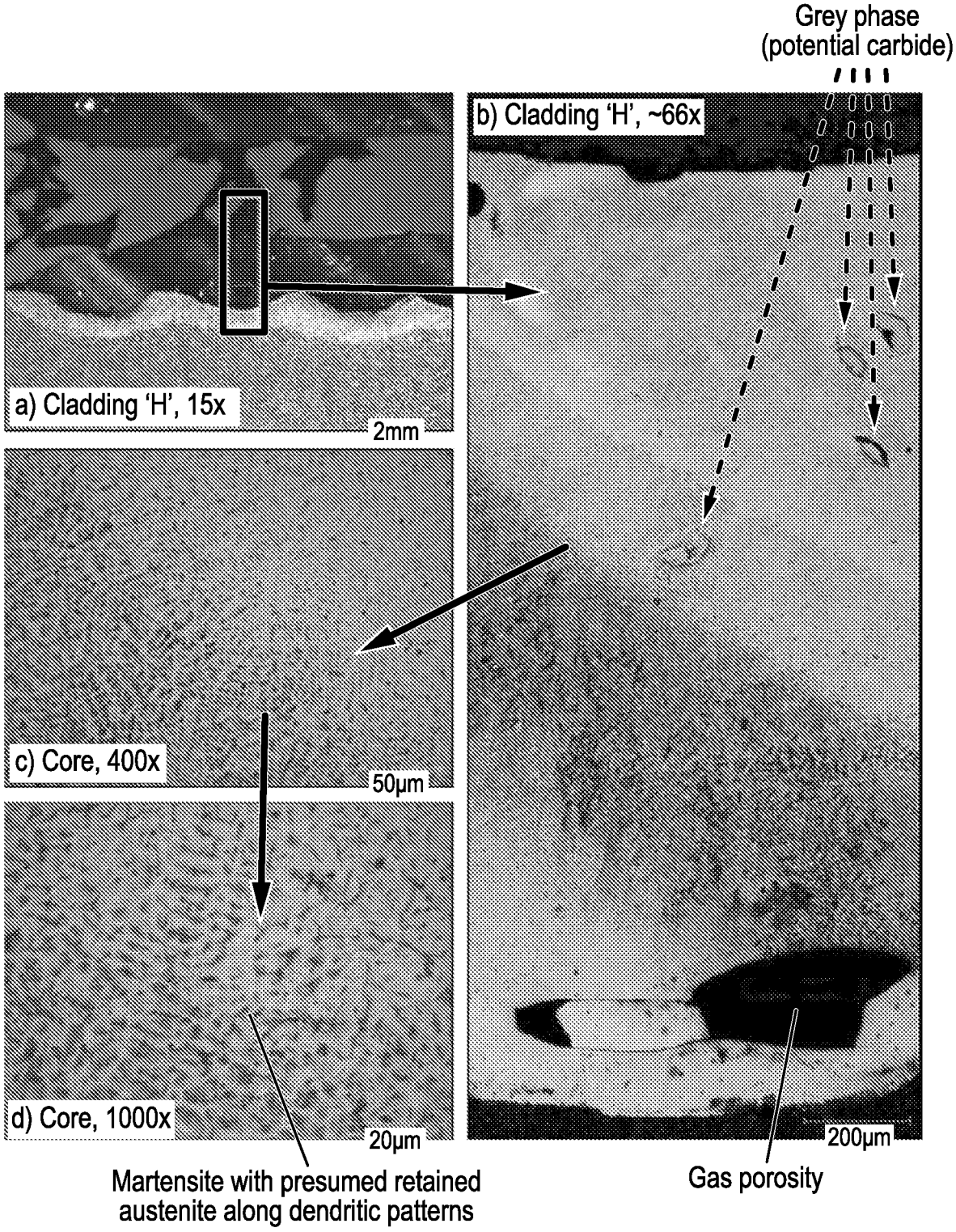
FIG. 10 shows different views of a double layer structure of the coating including the modified/improved S390 material in accordance with another embodiment of the present patent application.

FIG. 9 shows different views of a double layer structure of the coating including the modified/improved S390 material in accordance with one embodiment of the present patent application. That is, FIG. 10 shows the double layer structure of the coating including the modified/improved S390 material having a composition of powder mix E as shown in FIG. 7. The core microstructure was found to be comprised of martensite with retained austenite arranged in a columnar and dendritic pattern. Minor gas porosity was observed and tended to be located at the edges of adjacent cladding passes. Also, a grey phase is visible, which is likely comprised of carbide.

FIG. 10 shows different views of a double layer structure of the coating including the modified/improved S390 material in accordance with another embodiment of the present patent application. That is, FIG. 10 shows the double layer structure of the coating including the modified/improved S390 material having a composition of powder mix H as shown in FIG. 7. The microstructure was found to comprised of martensite and potential retained austenite. A large gas porosity was observed on this plane cross-sectioned. Porosity tended to be located at the edges of adjacent passes. A grey phase was sometimes observed and likely comprised of carbide.

Figure 11:
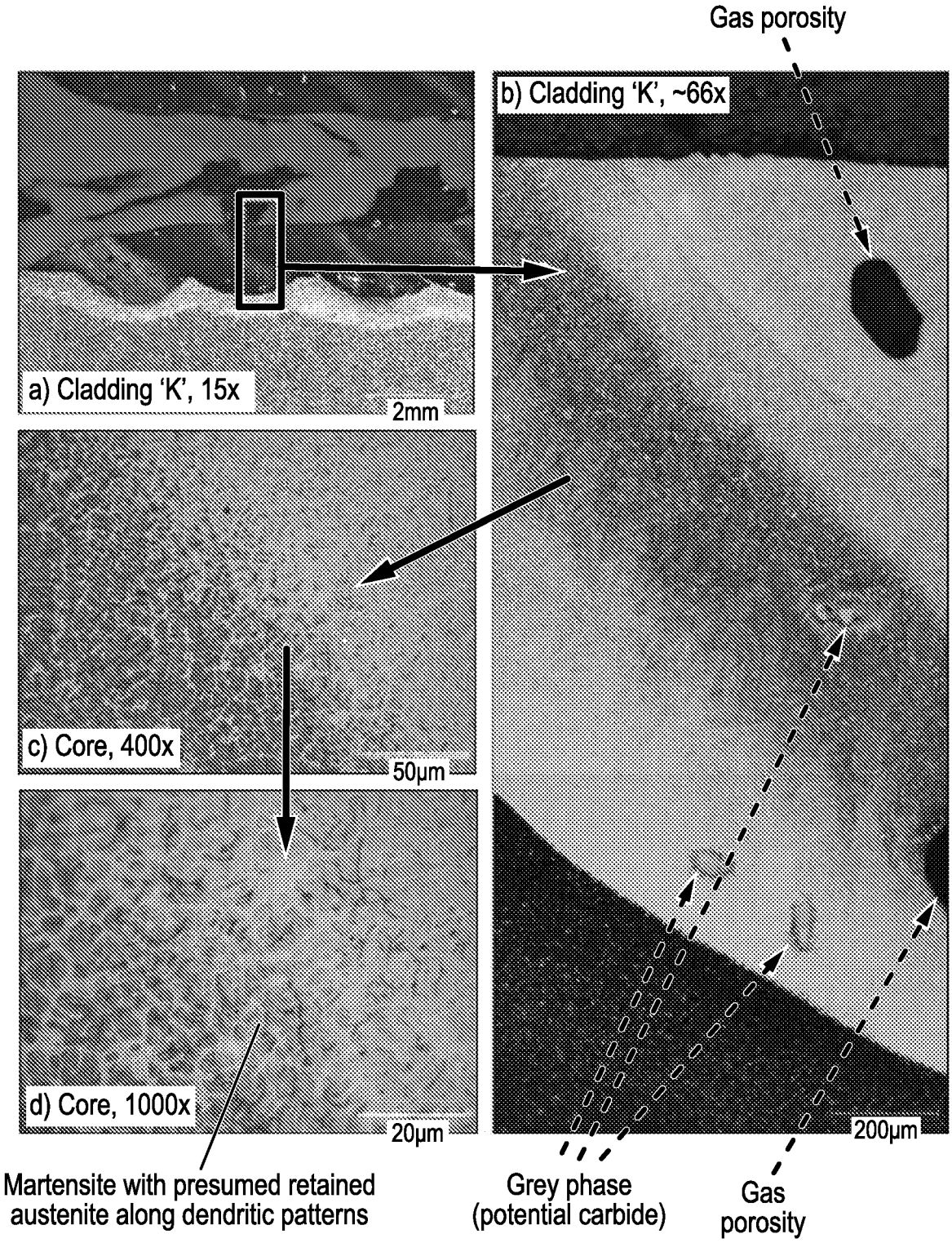
FIG. 11 shows different views of a double layer structure of the coating including the modified/improved S390 material in accordance with yet another embodiment of the present patent application.

FIG. 11 shows different views of a double layer structure of the coating including the modified/improved S390 material in accordance with yet another embodiment of the present patent application. That is, FIG. 10 shows the double layer structure of the coating including the modified/improved S390 material having a composition of powder mix K as shown in FIG. 7. The microstructure was found to comprised of martensite and potential retained austenite and was found to be similar to that of Mix E and Mix H. Gas porosity was also observed and tended to be located at the edges of adjacent cladding passes. A grey phase is visible, which is likely comprised of carbide.

Figure 14:
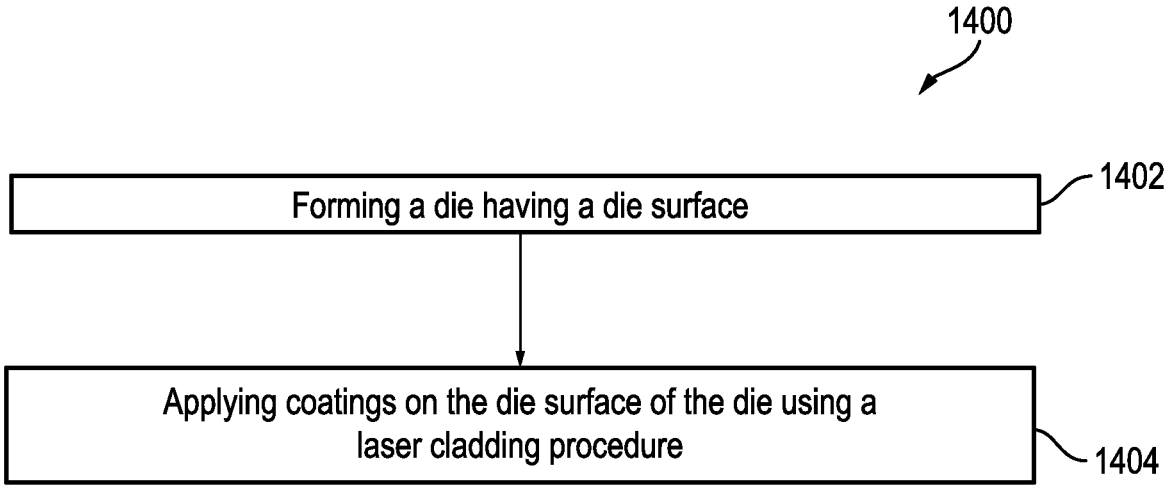
FIG. 14 shows a method of forming a die in accordance with an embodiment of the present patent application.

FIG. 14 shows a method 1400 of forming a die 12, 14 in accordance with an embodiment of the present patent application. The method 1400 comprises forming a die 12, 14 having a die surface 20, 26 at procedure 1402; and applying coatings 50 on the die surface of the die 12, 14 using a laser cladding procedure at procedure 1404. The coatings 50 includes a predetermined thickness, and a ratio of Vanadium to Tungsten in the coatings is in the range between 0.31 and 0.45. In one embodiment, the coatings 50 includes at least two layer configuration. In one embodiment, the predetermined thickness of the coating 50 is at least 2 millimeters. In one embodiment, the predetermined thickness of each of the coatings 50 is in the range between 0.75 millimeters and 1.25 millimeters thickness. In one embodiment, the coatings 50 includes a predetermined width. In one embodiment, the predetermined width of each of the coatings 50 is in the range between 3 millimeters and 5 millimeters. In one embodiment, the coating is formed on portions of the die surface that is subject to high wear during a hot forming procedure.

In one embodiment, the die surface 20 of the die 12 is configured to cooperate with a second die surface 26 of a second die 14 to form a die cavity 39 therebetween so as to receive a workpiece 30 therein. In one embodiment, the die cavity 39 is configured to have a shape that corresponds to a final shape of the workpiece 30 after a hot forming procedure.

In one embodiment, the automotive rear rails are made in the forming system of the present patent application. In another embodiment, various other automotive components are made in the forming system of the present patent application.

In one embodiment, the forming system of the present patent application may be used to form products having tailored tempered properties (TTP). For example, such products may include regions of reduced hardness, reduced strength and/or high ductility/yield/elongation in products. In one embodiment, the system of the present patent application may be used to form vehicle body pillars, vehicle rockers, vehicle roof rails, vehicle bumpers and vehicle door intrusion beams. In another embodiment, the system of the present patent application may be used to form customer required hot stamp structural components. In one embodiment, the hot formed member or component may be referred to as a hot stamped member or a hot shaped member. For example, hot stamping allows for the forming of complex part geometries with the final product achieving ultra-high strength material properties.

Although the present patent application has been described in detail for the purpose of illustration, it is to be understood that such detail is solely for that purpose and that the present patent application is not limited to the disclosed embodiments, but, on the contrary, is intended to cover modifications and equivalent arrangements that are within the spirit and scope of the appended claims. In addition, it is to be understood that the present patent application contemplates that, to the extent possible, one or more features of any embodiment can be combined with one or more features of any other embodiment.

What is claimed is:

1. A forming system comprising:

a first die having a first die surface;

a second die having a second die surface; and wherein the first and the second die surfaces are configured to cooperate to form a die cavity therebetween so as to receive a workpiece therein, coatings formed on opposing portions of the first and second die surfaces, the coatings on the opposing portions of the first and the second die surfaces cooperate to be on opposite sides of the workpiece received in the die cavity;

wherein each of the coatings includes a predetermined thickness, and wherein a ratio of Vanadium to Tungsten in the coatings is in the range between 0.31 and 0.45.

2. The forming system of claim 1, wherein the coatings are formed on the first die and the second die by a laser cladding procedure.

3. The forming system of claim 1, wherein the die cavity is configured to have a shape that corresponds to a final shape of the workpiece after a hot forming procedure.

4. The forming system of claim 1, wherein the coatings are formed on the opposing portions of the first and second die surfaces that are subject to high wear during a hot forming procedure.

5. The forming system of claim 1, wherein each of the coatings includes at least two layer configuration.

6. The forming system of claim 1, wherein the predetermined thickness of each of the coatings is at least 2 millimeters.

7. A method forming a die comprising:

forming a die having a die surface; and applying coatings on the die surface of the die using a laser cladding procedure, wherein the coatings includes a predetermined thickness, and wherein a ratio of Vanadium to Tungsten in the coatings is in the range between 0.31 and 0.45.

8. The method of claim 7, wherein the coatings includes at least two layer configuration.

9. The method of claim 7, wherein the predetermined thickness of each of the coatings is at least 2 millimeters.

10. The method of claim 7, wherein the coating is formed on portions of the die surface that is subject to high wear during a hot forming procedure.

11. The method of claim 7, wherein the die surface of the die is configured to cooperate with a second die surface of a second die to form a die cavity therebetween so as to receive a workpiece therein.

12. The method of claim 11, the die cavity is configured to have a shape that corresponds to a final shape of the workpiece after a hot forming procedure.

* * * * *